US005918444A

United States Patent [19]

Kuchler

[11] Patent Number: 5,918,444

[45] Date of Patent: Jul. 6, 1999

[54] COLD CUT SLICER WITH PACKAGING DEVICE

[75] Inventor: Fritz Kuchler, Klatteweg 4-6, A-9010 Klagenfurt, Austria

[73] Assignee: Fritz Kuchler, Klagenfurt, Austria

[21] Appl. No.: 08/994,310

[22] Filed: Dec. 19, 1997

[30] Foreign Application Priority Data

Dec. 20, 1996 [AT] Austria ..... 2237/96

[51] Int. Cl.[6] ..... B65B 63/00

[52] U.S. Cl. ..... 53/517; 53/514; 53/157; 53/389.3; 53/373.7; 83/155.1; 83/932

[58] Field of Search ..... 426/414; 83/155.1, 83/932; 53/157, 389.1, 389.3, 435, 373.7, 514, 517, 122

[56] References Cited

U.S. PATENT DOCUMENTS

| | | | |
|---|---|---|---|
| 3,009,304 | 11/1961 | Swick . | |
| 3,488,918 | 1/1970 | Felstehausen . | |
| 3,834,259 | 9/1974 | Kuchler | 83/155.1 X |
| 3,952,478 | 4/1976 | Richards et al. | 53/157 X |
| 4,008,554 | 2/1977 | Hardy | 53/559 X |
| 4,134,246 | 1/1979 | Michels | 53/559 |
| 4,185,527 | 1/1980 | Kuchler | 83/88 |
| 4,524,558 | 6/1985 | Miles | 53/157 |
| 4,644,729 | 2/1987 | Fessler | 53/157 |
| 4,763,738 | 8/1988 | Kuchler | 83/77 X |
| 4,793,228 | 12/1988 | Etter et al. | 83/155.1 |
| 5,101,702 | 4/1992 | Kuchler | 83/932 X |
| 5,138,823 | 8/1992 | Hartmann et al. | 53/157 X |
| 5,391,386 | 2/1995 | Mally | 53/517 X |
| 5,426,917 | 6/1995 | Daane et al. | 53/517 |

FOREIGN PATENT DOCUMENTS

| | | |
|---|---|---|
| 0 456 634 | 11/1991 | European Pat. Off. . |
| 0 515 661 | 12/1992 | European Pat. Off. . |
| 0 574 649 | 12/1993 | European Pat. Off. . |
| 36 44 716 | 7/1988 | Germany . |
| 295 00 342 | 8/1995 | Germany . |
| 1073806 | 6/1967 | United Kingdom . |

*Primary Examiner*—Daniel B. Moon
*Attorney, Agent, or Firm*—Kenyon & Kenyon

[57] ABSTRACT

A cold cut slicer having a packaging device is comprised of a sheeting roll having a pulling-out device, and a cutting device for supporting sheets or covering sheets, which are grasped by a swivel arm having evacuatable suction heads and which are brought to the setting-down location of the cold cut slicer. If the swivel arm is extendable, telescope-like, it can additionally grasp and swivel a tray. The cold cuts are stacked or fanned out on the sheeting or the tray. The goods are conveyed by a conveyor belt to a sealing station having a lifting frame and a sealing frame. The lifting frame raises the package made up of sheeting and cold cuts and presses it against the sealing frame. The result is a sealing that is tight all around the package, or is interrupted at the comers, or that is open on one side, like a sack. A short conveyor belt provided in the lifting frame ejects the sealed goods.

9 Claims, 2 Drawing Sheets

COLD CUT SLICER WITH PACKAGING DEVICE

FIELD OF THE INVENTION

The present invention relates to a cold cut slicer including a cold cuts movable tray, which is capable of being automatically driven, having a cold-cut forward-feed mechanism acting towards a limit stop plate, which leads to a circular knife, also including a program-controlled setting-down device having a chain frame made up of parallel conveyor chain-links or conveyor bands, fitted with pointed nibs, and having a beater, which grasps the slices from behind the chain- links or bands and is capable of folding over towards a setting-down location on a conveyor belt, which runs beneath the setting-down device, and a roll of thermoplastic, e.g., polypropylene, sheeting, being supported adjacent to the setting-down location, there being assigned to said roll a pulling-out and cutting device, as well as a swivelling device for separating and positioning supporting and/or covering sheets for a cold-cut slice in the setting-down location.

BACKGROUND INFORMATION

Cold cut slicers for store counters are known, producing ready-to-serve cold cut products. Such machines are also suitable for preparing cold cuts that, until sold, are visible during storage in refrigerated windows.

U.S. Pat. No. 3,488,918 describes that patties which are placed on cut-off sheeting pieces by means of a swivel arm. A device for holding and releasing the sheeting is described. When a sheeting piece is released onto the conveyor belt, a patty can then be swivelled over and set down. The process is repeated multiple times, resulting in a stack having sheeting separators. No provision is made for a particular cold cut slicer or a sealing device.

German Patent Application No. 36 44 716 relates to an automatic cold cut slicer having a transporting device, a setting-down device, a conveying apparatus and a separator-sheet delivery apparatus. The foodstuff slices are supplied to the rear side of the transport device and are conveyed to the setting-down device. The separator-sheet delivery apparatus comprises a forward-feed device, a swivel plate having holes, and a separating apparatus for the sheeting.

United Kingdom Patent Application No. 1 073 806 describes a single sheet feeding device without having any relation to a cold cut slicer. It is a very specialized machine-engineering design, in which suction devices are installed on a swivel head for picking up individual sheets.

European Patent Application No. 0 874 649 relates to a control system of a cold cut slicer, which initiates a cutting operation in accordance with need (e.g., deriving from product-specific turnover, as indicated by means of computerized cash registers).

Independently of cold cut slicers of the above-mentioned design, industrial foodstuff packaging machines are known which are not suitable for direct use in stores, but rather function exclusively for preparing packaged, sliced goods.

SUMMARY OF THE INVENTION

One of the objects of the present invention is to provide a cold cut slicer with a packaging device, the cold cut slicer being of the type which is used directly on a store counter and which has the features mentioned above. A cold cut slice is set down on a sheeting piece, or, optionally, on a tray that rests on the sheeting, and is subsequently heat-sealed. This is achieved in that the swivel device has a generally known swivel arm having suction heads and in that, on the other side of the setting-down device, the conveyor belt leads to a heat-sealing station, which has a heatable sealing frame, opposite which is situated a lifting frame, encompassing or reaching past the conveyor belt, for lifting a slice which has been placed on a supporting sheet and is covered by a covering sheet from the transport position on the conveyor belt into the sealing position, and for pressing it against the sealing frame. The transfer, by means of the swivel arm having suction heads, of the supporting or covering sheets, cut from at least one sheeting roll, onto the conveyor belt in the setting-down location of the slicer. The conveyor belt extending beneath the setting-down device; and the sealing station furnished with a lifting frame for air-tight packaging—these two features permit an extremely compact design, exceptional flexibility regarding components, ease of serviceability with great functional reliability. In the usual fashion, after a sausage stick has been placed in position, the cold cut slicer operates and apportions the cold cuts fully automatically, and it can also be employed by itself.

It is expedient if the heating element of one side bar of the sealing frame can be turned off, so that the sheeting pieces lying on top of each other can be sealed, pouch-like, and the inner space can optionally be evacuated and subsequently sealed up. The evacuating can take place in a downstream operation. Simple, conventional systems can be assigned directly to the sealing station. Another embodiment according to the present invention provides that the swivel arm is designed to be extendable in two places, telescope-like, and that in the swivel range of one of its positions, a stack of cups or trays, e.g., made of polystyrene, and in the other position, the supporting or covering sheets can be grasped by the suction head(s) of the swivel arm and placed on top of each other in the setting-down location of the cold cut slicer. Then, in each case, a supporting sheet can be brought to the setting-down location and then a cup placed on top of it. After completion of the slicing and setting-down process, a covering sheet is placed on top and the entire unit is conveyed through to the sealing station by the conveyor belt operating underneath the setting-down device. At the sealing station, the lifting frame lifts the package up and presses it against the sealing frame, which is only heated during the closing process or only when the sheeting pieces to be sealed are placed in position. Then the lifting frame is lowered and the sealed package is transported away or released by the device. Instead of by sealing, it is also possible to join the sheeting pieces by pressing. Tooth constructions or form-locking connections of various kinds can also be employed.

The processes are coordinated electronically. For this purpose, provision is made for an electronic control system, for synchronizing: the successive actions of separating a sheeting strip for use as a supporting sheet; the grasping and swiveling by means of the swivel arm; the triggering of a preselected number of traversals for the cold cuts movable tray, including the cold cuts forward-feed mechanism and the setting-down device; the action of separating a further piece of sheeting as a covering sheet and swivelling it for placement on the slice, and, if appropriate, activating one or a plurality of further cutting cycles, in each case, a separator sheet being placed down; the activating of the conveyor belt drive until the sealing position is reached; the lift-actuating of the lifting frame; the supplying of voltage to the heating element of the sealing frame and, optionally, the switching off of the heating element of a cross bar of the heating frame; the returning of the lifting device; and the further transporting of the sealed package to a location where it can be released from the conveyor belt. All functions are freely selectable in the framework of the programs. Thus, after furnishing a supporting sheet, and, optionally, a polystyrene tray, in the setting-down location, a first slice or stack, e.g., fanned out, is set down. On top of this is placed a further supporting sheet, reduced, optionally, in all dimensions, so that a slice may be placed on top of it, etc., until a covering sheet covers the entire unit. After being transported to the sealing location, the supporting sheet and covering sheet are sealed to each other. Should the need arise, the separator sheets can also be sealed. By means of a forward-feed operation in the conveying direction, the individual layers can be offset with respect to each other, overlapping like fish scales, and the sheets sealed in this position. Entire pouches can be evacuated.

DETAILED DESCRIPTION OF THE DRAWINGS

Figure 1:
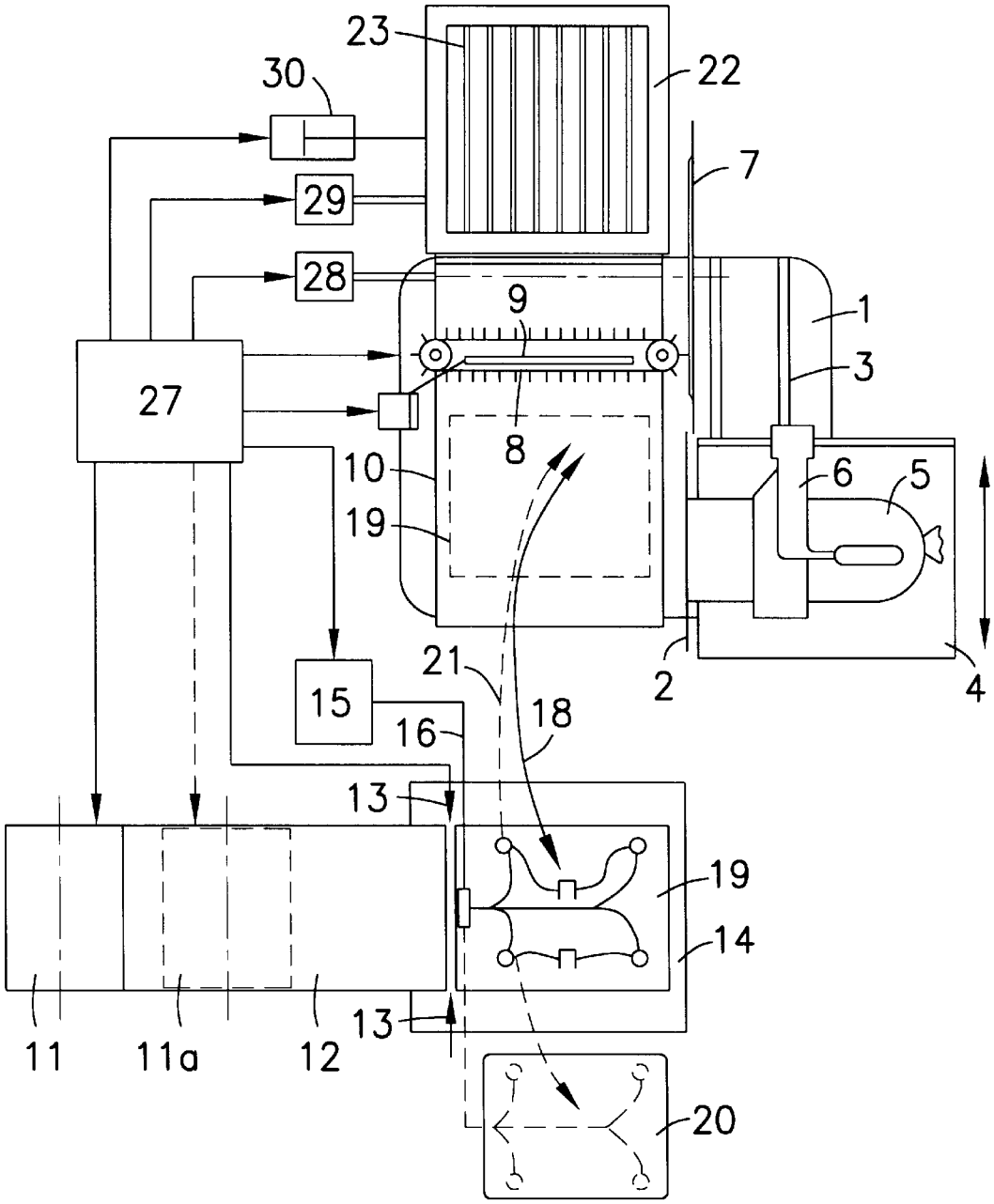
FIG. 1 shows a horizontal planar view of a cold cut slicer according to the present invention, without a sealing frame.

FIG. 1shows an automatic cold cut slicer 1, having a reversibly driven cold cuts movable tray 4 running in guideways 3 along a limit stop plate 2. A sausage 5 is clamped on cold cuts movable tray 4 in a cold cuts holder 6, cold cuts movable tray 4 being pushed forward with its every traversal. A circular knife 7 is rotatingly driven. The cut-off cold cuts slices arrive at a setting-down device, which comprises a conveying chain or belt 8, which is fitted with pointed nibs. A beater 9 pulls the sliced cold cut, e.g., a sausage slice, from the pointed nibs and, with a rotary motion, throws it onto a conveyor belt 10 in the setting-down location.

In front of conveyer belt 10, adjacent to the setting-down location, a roll 11 of thermoplastic sheeting 12 is supported. A cutting device 13, indicated here with two arrows, cuts off one sheeting piece as a supporting- or covering sheet for the cold cut, e.g., the sausage slice, the cold cut coming to rest for the moment on a transfer table 14. Undepicted is a pulling-out device for sheeting roll 11, which each time draws out one piece in the required length from roll 11.

A swivel arm 16 driven by an electrical motor 15 carries at its end four suction heads 17, which are evacuated like suction cups, by means of a system of thin hoses. A hinged rectangle, as swivel arm 16, ensures that four suction heads 17 always remain roughly horizontal during the swivelling as shown by arrow 18, so that the separated sheeting piece, here represented as supporting sheet 19, is placed onto conveying belt 10. This process takes place prior to the automatic cutting operation of cold cut slicer 1.

Swivel arm 16 can be extended, telescope-like, and it can reach a stack of trays 20, e.g., made of polystyrene, and thus transfer a tray 20 of that type to the setting-down location on conveyor belt 10 (arrow 21). A supporting sheet 19 can be placed underneath tray 20 and/or on the tray. Should a variety of supporting-, separator-, or covering sheets be used, the sheeting station can be fitted with additional sheeting rolls 11*a,* which, alternately, are cut into individual sheets and are brought by swivel arm 16 to the setting-down location of the cold cut slicer.

Figure 2:
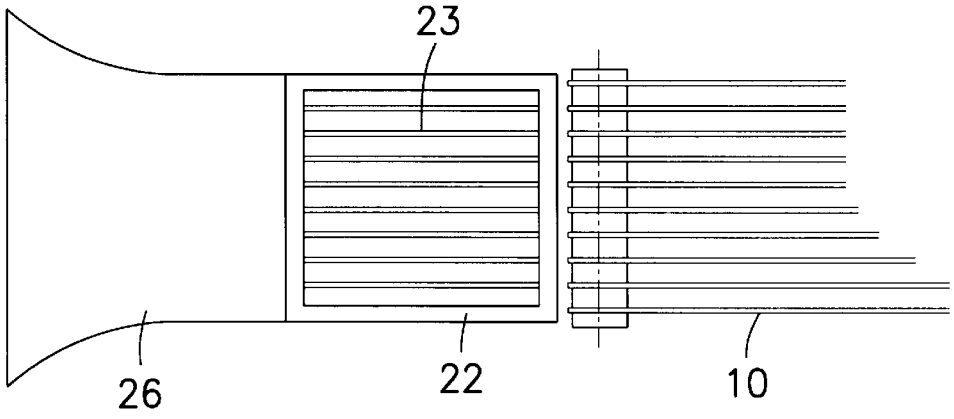
FIG. 2 shows a detailed view of a sealing device, without the sealing frame.
Figure 3:
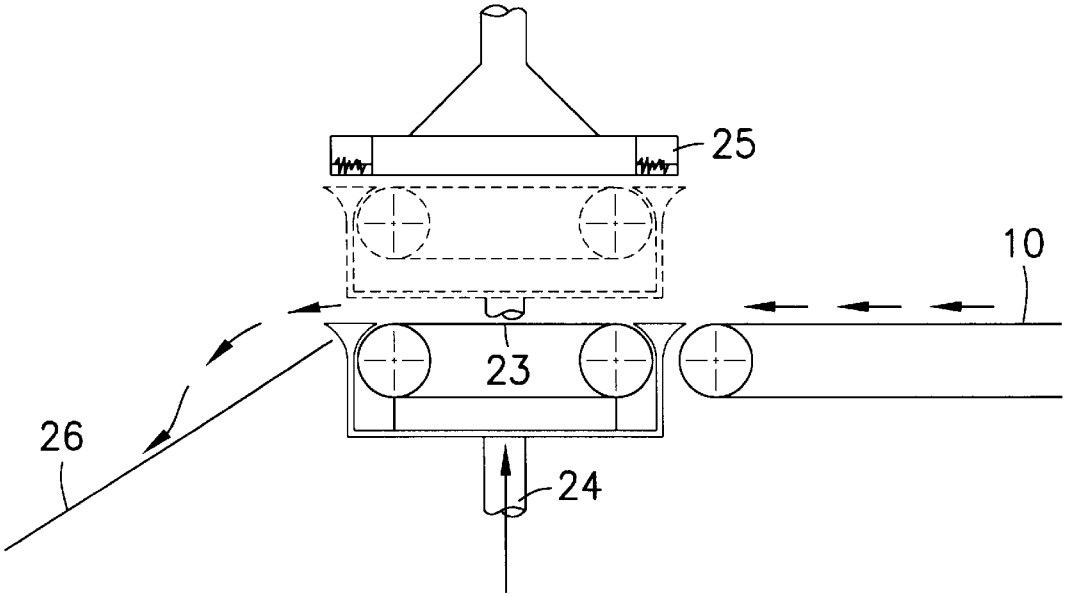
FIG. 3 shows a side view of the sealing device illustrated in FIG. 2.

Conveying belt 10 runs underneath conveying chains 8 and conveys the sliced sausage, which is situated between a supporting sheet and a covering sheet, to a sheeting sealing station, as is shown in greater detail in FIG. 2 or 3. The sheeting sealing station includes a lifting frame 22 and a short conveyor belt 23 arranged within lifting frame 22. This unit can be lifted by a piston 24, e.g., hydraulically, in the process moving towards an electrically heated sealing frame 25. The four sides of sealing frame 25 can be individually heated and also, optionally, individually switched off, so that in the process of sealing the package made up of sheeting and cold cuts, the result can be not only a cushion-type package that is sealed on all sides, but also a sack which is open on one side. It is also possible to intentionally interrupt the edge sealing at the corners, so that any air which may be present, or gases which may have been produced, can escape. The above-mentioned productions can be placed directly on the market as end products or, as intermediate products, can be conveyed for evacuating and subsequent sealing ("with company seal") of the open side or of the corner(s) initially left unsealed.

Short conveyor belt 23 centrally positions the package made up of sheeting and cold cuts under sealing frame 25, which works together and is congruent with lifting frame 22. After the sealing process is completed, conveyor belt 23 conveys the package from the sealing device onto a slideway 26 for further use.

The above-mentioned operations are actuated by a programmable control system 27. The latter activates the drive for sheeting roll 11 or 11*a,* until the sheeting web rests on transfer table 14. End switches signal the arrival at this location. At this point, cutting device 13 is actuated and a supporting sheet 19 is separated from roll 11 or 11*a*. Thereupon, swivel motor 15 is connected to the voltage supply, the suction heads being evacuated and supporting sheet 19 being grasped and placed onto conveyor belt 10. Swivel arm 16 can also be extended in telescope fashion, and it can place a tray 20 onto supporting sheet 19. Then the control system activates cold cut slicer 1, which in a known manner, prepares stacks, fanned-out slices, or the like. A plurality of cold-cut layers, each, for example, having identical quantities of cold cuts, can be set down using, in each case, covering sheets as separators. The control system then repeatedly executes the operation described in connection with supporting sheet 19, with respect to swivel arm 16, the sheeting pieces then taking on the function of either separator sheets or covering sheets. As described above, these separator sheets can ultimately be sealed along the edges, so that the user receives a cold cuts stack that is multiply subdivided and compartmentalized. The user can have access to the topmost cold cuts leaving the layers below in their original packaging. Both hygiene and non-perishability are thus improved.

Control system 27 also turns drive 28 of conveyor belt 10 on and off, and, in this manner, it conveys the cold cuts to the sealing station, the cold cuts being placed between at least two sheeting pieces, the precise positioning being carried out by conveyor belts 23, whose drive 29 is switched off by control system 27 upon the cold cuts reaching the central position. Control system 27 then actuates a hydraulic lifting device 30 having piston 24, and it switches on the heating element in sealing frame 25. After the sealing is completed, piston 24 is lowered and the packaged goods are ejected by switching on drive 29 once again.

What is claimed is:

1. A cold-cut slicer, comprising:

a cold-cut movable tray being automatically driven, including a cold-cut forward-feed mechanism and extending to a circular knife, the cold-cut forward-feed mechanism being biased toward a limit stop plate;

a program-controlled setting-down device including a chain frame, the chain frame being composed of parallel conveyor chain-links or parallel conveyor bands and having a beater, the beater gripping at least one slice from a first location behind the parallel conveyor chain-links or the parallel conveyor bands;

pointed nibs fitted on the chain frame;

a conveyor belt extending beneath the program-controlled setting-down device, the beater being foldable towards a second location on the conveyor belt;

a pull-out cutting device;

a swivel device including a swivel arm having suction heads, the pull-out cutting device and the swivel device cooperating with a roll to separate and position at least one of a supporting sheet and a covering sheet provided for the at least one slice in the second location, the roll being composed of a thermoplastic material and situated adjacent to the second location; and a sealing station provided opposite to the program-controlled setting-down device, the sealing station including a heatable sealing frame and a lifting frame provided opposite to the heatable sealing frame, wherein the conveyor belt leads to the sealing station, the sealing station encompassing and overreaching the conveyor belt for lifting the at least one slice which is placed on the supporting sheet and covered by the covering sheet, the at least one slice being lifted from a transport position on the conveyor belt to be positioned into a sealing position, and wherein the sealing station presses the at least one slice against the heatable sealing frame.

2. The cold-cut slicer according to claim 1, wherein the thermoplastic material includes a polypropylene material.

3. The cold-cut slicer according to claim 1, wherein the supporting sheet includes a plurality of sheets, and wherein the heatable sealing frame includes a side bar having a heating element, the heating element being switched-off for sealing the plurality of sheets lying on top of one another in a form of a sack.

4. The cold-cut slicer according to claim 3, wherein, after an inner space of the sack is evacuated, the inner space is sealed.

5. The cold-cut slicer according to claim 1, wherein the swivel arm extends in a telescope-like manner to two positions, and wherein, in a first swivel range of a first position of the two positions, the suction heads of the swivel arm are capable of gripping a stack of cups or trays and placing the cups or trays on top of one another at the second location, and wherein, in a second swivel range of a second position of the two positions, the suction heads of the swivel arm are capable of gripping the supporting sheet or the covering sheet and placing the supporting sheet or the covering sheet on top of one another at the second location.

6. The cold-cut slicer according to claim 5, further comprising:

an electronic control system controlling:

the pull-out cutting device and the swivel device to successively separate a sheeting strip used as the supporting sheet, the swivel arm to grasp and to swivel objects, the cold-cut forward feed mechanism and the program-controlled setting-down device to provide a predetermined number of traversals of the cold-cut movable tray, the pull-out cutting device and the swivel device to separate a further sheeting strip used as the covering sheet and to swivel the further sheeting strip to be placed on the at least one slice, a conveyor belt drive to control the conveyor belt until the sealing position is reached, a lifting device to lift-actuate the lifting frame and to return the lifting frame device to its original position, a further device to supply a predetermined voltage to a heating element of the heatable sealing frame, and the further device to further transport a sealed package from the conveyor belt to a release position.

7. The cold-cut slicer according to claim 6, wherein the electronic control system controls the pull-out cutting device and the swivel device to activate at least one cutting cycle and to place down a separator sheet.

8. The cold-cut slicer according to claim 6, wherein the electronic control system controls the further device to switch-off the heating element of a cross bar of the heatable sealing frame.

9. The cold-cut slicer according to claim 9, wherein the cups or the trays are composed of a polystyrene material.

* * * * *